US005649784A

United States Patent [19]

Ricaud et al.

[11] Patent Number: 5,649,784

[45] Date of Patent: Jul. 22, 1997

[54] EXPANSION JOINT SYSTEM AND METHOD OF MAKING

[75] Inventors: Robert E. Ricaud, Maineville; David A. Brooks, Pickerington; Timothy O. Martin, West Chester, all of Ohio

[73] Assignee: Pavetech International, Inc., Cincinnati, Ohio

[21] Appl. No.: 491,268

[22] Filed: Jun. 16, 1995

[51] Int. Cl.[6] ..... E01C 11/02

[52] U.S. Cl. ..... 404/47; 14/73.1; 404/53; 404/67; 404/68; 52/396.02

[58] Field of Search ..... 404/47, 48, 49, 404/53, 67, 68, 69, 74; 14/73.1; 52/396.02, 396.03, 396.04, 403.01

[56] References Cited

U.S. PATENT DOCUMENTS

| | | | |
|---|---|---|---|
| 3,223,005 | 12/1965 | Carlson | 404/47 |
| 3,474,625 | 10/1969 | Draper et al. | 405/270 |
| 3,827,204 | 8/1974 | Walters | 52/396.04 |
| 4,015,302 | 4/1977 | Clark | 14/16.5 |
| 4,279,533 | 7/1981 | Peterson et al. | 404/68 |
| 4,324,504 | 4/1982 | Cottingham et al. | 404/74 |
| 4,784,516 | 11/1988 | Cox | 404/69 |
| 4,923,328 | 5/1990 | Arps et al. | 404/69 |
| 5,024,554 | 6/1991 | Benneyworth et al. | 404/74 |
| 5,190,395 | 3/1993 | Cathey et al. | 404/74 |
| 5,513,927 | 5/1996 | Baker et al. | 404/47 |

FOREIGN PATENT DOCUMENTS 2065203 6/1981 United Kingdom .

OTHER PUBLICATIONS

The Charnway Bridge Joint, Dec. 1987, Charnway Systems Limited, Specialist Construction Materials.

Watson Bowman Acme, Expandex Product Data, Dec. 1991.

The Agrement Board, Certificate No. 81/897, Asphapol Polymer-modified Asphalt Road Surfacing.

*Primary Examiner*—Henry A. Bennett
*Assistant Examiner*—Pamela A. O'Connor
*Attorney, Agent, or Firm*—Wood, Herron & Evans, P.L.L.

[57] ABSTRACT

A method of making a flexible, yet durable expansion joint that is at a general even grade with abutting roadway surfaces. The method includes cutting a recess into adjacent roadway slabs having a gap therebetween, and thereafter cleaning the recesses. A flexible membrane strip is placed across the gap from slab to slab and secured thereto. Then, the recesses and gap are substantially filled with a mixture of sealant and aggregate. A final layer of aggregate is applied on top of the mixture such that the final layer of aggregate is at about an even grade with the abutting roadway slabs.

22 Claims, 1 Drawing Sheet

EXPANSION JOINT SYSTEM AND METHOD OF MAKING

FIELD OF THE INVENTION

This invention relates generally to a method of producing an expansion joint for adjacent roadway slabs, and more particularly, to a method of producing a durable expansion joint for bridges that is not recessed from adjacent slabs, but is at a generally even grade therewith.

BACKGROUND OF THE INVENTION

It is necessary that roadways and bridges be built of sections of slabs with an expansion gap between adjacent slabs to accommodate for environmental changes in temperature and vehicular traffic. Generally, the slabs expand with increasing temperatures and contract with decreasing temperatures. Furthermore, the slabs must be capable of moving vertically to accommodate for vehicular traffic.

A durable, yet flexible joint between the slabs is desirable. Additionally, a flexible joint which is waterproof is warranted to prevent water from getting under the slabs and rusting the bridges. A waterproof joint is also desirable to keep various corrosives such as roadway salt, fuel, oil, etc. from passing through the joint.

Various expansion joints are known in the art. One disadvantage of many prior art expansion joints is that they are typically recessed somewhat from the abutting surfaces so that when a vehicle passes thereover, a slight dip is felt. Dirt and debris fill the recess of the joint and accelerate deterioration of the joint. If the joint becomes unsealed at any juncture the dirt and debris become lodged in that unsealed portion and further tear the joint apart. The joint quickly degenerates as more dirt and debris become lodged in the unsealed portions of the joint.

Another disadvantage of many prior art expansion joints is that the material used to fill the gap of the joint must be able to bond to the adjacent slabs in some way. Typically, a recess is cut into the adjacent slabs and filled with particular materials capable of bonding to the gap-filling material. However, such recess-filling materials are limited in number because of the requirement of having to be able to bond to the gap-filling material. Furthermore, expansion and contraction of the joint often weakens the bond between the gap-filling material and the recess-filling material so that the bond breaks and separation between the two materials occurs. These prior art expansion joints therefore do not have a long-lasting life, but must be repaired and/or replaced frequently.

Accordingly, it is a primary objective of this invention to produce an expansion joint that is not recessed from the abutting surfaces, but is at a generally even grade therewith. This will prevent dirt and debris from accelerating deterioration of the joint, thereby resulting in a long-lasting, cost-effective expansion joint.

It is yet another object of this invention to produce an expansion joint comprised of a homogenous material throughout the joint to eliminate the bonding difficulties present in the prior art expansion joints. It is still yet another object of this invention to provide a method for producing an expansion joint, quickly and economically.

SUMMARY OF THE INVENTION

This invention provides a method of producing a cost-effective, long-lasting expansion joint to be used for roadways, bridges and the like. A gap is located between adjacent roadway slabs to accommodate for expansion and contraction of the slabs as temperatures vary, and for vehicular traffic. A recess is cut or formed in the top surface of each adjacent roadway slab to form a pair of parallel recesses that are adjacent to the gap. Both recesses have a base surface that is generally parallel to the top surface of the slabs, as well as a side surface that is generally perpendicular to the top surface of the slabs. The base surface and wall surface of each recess is then cleaned.

A generally flexible membrane strip is placed across the gap. One end of the strip is secured to one base surface while the other end of the strip is secured to the other base surface of the recesses. After securing the membrane strip across the gap, the base surface and wall surface of each recess may be advantageously coated with a solvent-based primer. Thereafter, the recesses and gap are substantially filled with a mixture of an initially liquid sealant and an aggregate.

Thereafter, a finishing layer of aggregate is applied on top of the mixture. The layer of aggregate is in about a level position with the top surface of the roadway slabs so that a smooth expansion joint is formed between the adjacent roadway slabs.

In another, preferred embodiment of the invention, after securing the membrane strip a mesh retainer, preferably L-shaped, is secured in each respective recess to form a pair of opposing retainers. A first portion of the retainer is disposed upon the respective end of the membrane strip. A second portion of the retainer extends generally perpendicularly from this respective end of the membrane strip and is immediately adjacent to the gap. After the retainers are secured, the recesses are substantially filled with the mixture of sealant and aggregate. The liquid sealant flows through the mesh retainers into the gap between the roadway slabs and is supported by the membrane strip. The aggregate, however, is retained adjacent to the gap by each retainer. After the mixture and sealant are in each recess and gap respectively, a finishing layer of aggregate is applied thereon to a position about level with the top surface of the roadway slabs so that a smooth expansion joint is formed between the adjacent roadway slabs.

In other subsidiary aspects of the invention, the membrane strip is comprised of a rubber-based material. Also, two retainers are employed, with the second portion of each retainer extending perpendicularly to a position slightly below the roadway slabs, such as about ⅛" to ½" therebelow. In another aspect, the aggregate may be about ¾" stone, and pre-coated with a sealant. The sealant utilized in the mixture, as well as that utilized to pre-coat the aggregate, is typically polyurethane based. Furthermore, a final coating of sealant may be applied after the recesses and gap are substantially filled with the mixture but before the final layer of aggregate is applied, so that the aggregate is applied on top of this final coating of sealant.

DETAILED DESCRIPTION OF PREFERRED EMBODIMENT

Figure 1:
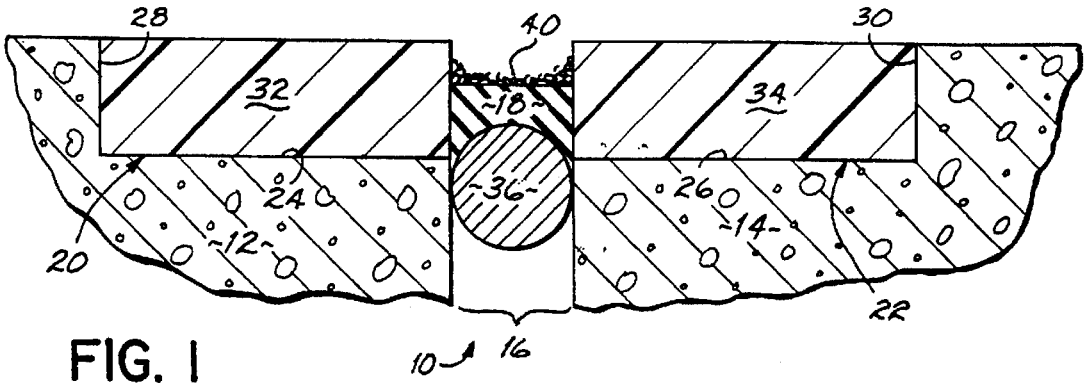
FIG. 1 PRIOR ART
FIG. 1 is a sectional view of an expansion joint system of the prior art.

With reference to FIG. 1, a prior art expansion joint system 10 is provided. It is of the type shown in U.S. Pat.

No. 5,190,395. Adjacent roadway slabs 12, 14 are shown having a gap 16 therebetween. Gap 16 is typically filled with a silicone sealant 18.

Before sealant 18 is poured into gap, a number of preparatory steps must be taken. First, a recess 20 and 22 respectively, having a base surface 24 and 26 and a side wall surface 28 and 30, must first be formed in each adjacent roadway slab 12, 14. After cleaning and priming surfaces 24, 26, 28, 30, a temporary rectangular form (not shown) is installed in gap 16 between slabs 12, 14. Each recess 20, 22 is then filled with an elastomeric concrete nosing 32 and 34 respectively. Nosings 32, 34 are comprised generally of an epoxy primer and an aggregate such as crushed stone, and have an adhering quality to silicone sealant 18, which is necessary so that gap 16 can be properly filled. Once nosings 32, 34 have cured, the form is removed.

Before silicone sealant 18 can be placed in gap 16, however, a backer rod 36 must be inserted and wedged in gap 16 between nosings 32, 34. Backer rod 36 is used as a shelf to receive silicone sealant 18. Once backer rod 36 is in place, sealant 18 is poured in gap 16 on top of backer rod 36. Sealant is not poured to an even grade with slabs 12, 14 because when the environmental temperature rises, slabs 12, 14 expand and compress sealant convexly. If sealant 18 were at an even grade with slabs 12, 14 and then were compressed convexly upon increasing temperatures, sealant 18 would be in a position above the grade of slabs 12, 14 and subject to extreme wear and tear from vehicular traffic (not shown). Sealant 18 is not designed for such extreme wear and tear, and would quickly deteriorate. Thus, it is necessary that sealant 18 be at a level below the grade of slabs 12, 14 so that sealant 18 is recessed.

Because sealant 18 is recessed from the grade of slabs 12, 14, dirt and debris 40 accumulate on top of the recessed sealant 18. Dirt and debris 40 excel deterioration of joint system 10 by becoming lodged between sealant 18 and adjacent nosings 32, 34. This, in turn, weakens the bond between sealant 18 and nosings 32, 34 so that sealant 18 eventually becomes torn away from adjacent nosings 32, 34. Contraction and expansion of joint system 10 that occur with changing temperatures further weakens the adhesion between the gap-filling material and the recess-filling material. Joint system 10, therefore, quickly deteriorates and must be repaired and/or replaced often.

Figure 2:
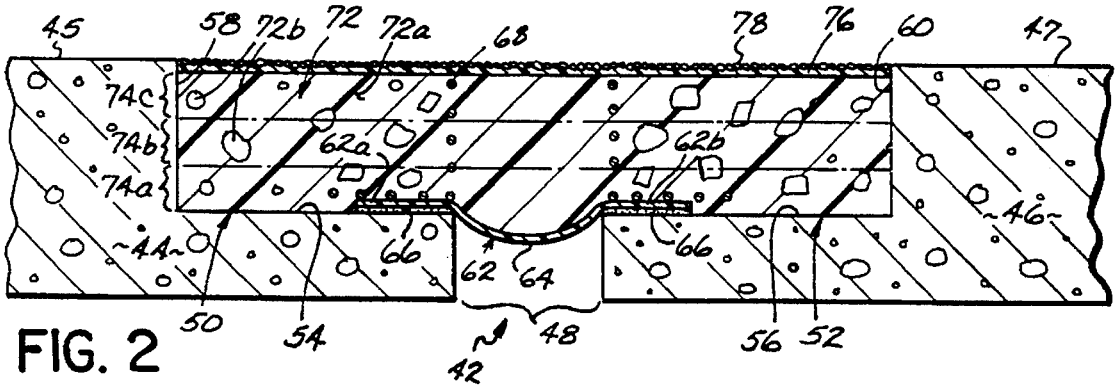
FIG. 2 is a sectional view of a preferred embodiment of an expansion joint system of the present invention, in a contracted position.
Figure 3:
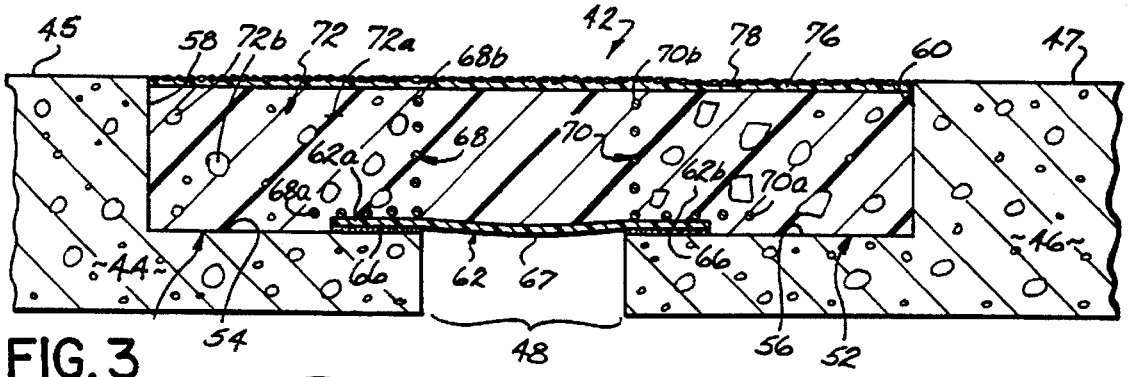
FIG. 3 is a sectional view of the invention of FIG. 2 in an expanded position.
Figure 4:
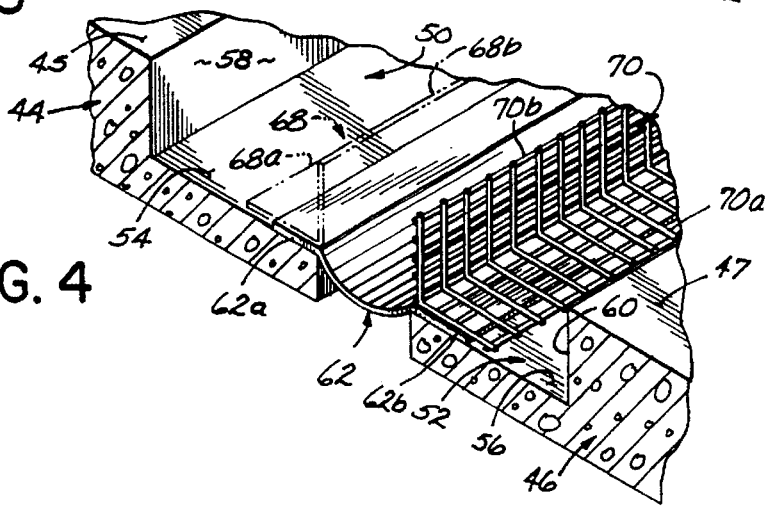
FIG. 4 is a sectional view of a pair of retainers of the invention of FIG. 2.

Problems encountered with prior art expansion joint systems 10 as shown in FIG. 1 are resolved with the expansion joint system 42 of the present invention as shown in FIG. 2, FIG. 3, and FIG. 4. Roadway slabs, 44 and 46 respectively, are adjacent to each other with a gap 48 therebetween. A recess, 50 and 52, respectively having a base surface 54, 56 and a side wall surface 58, 60, is formed in each adjacent roadway slab 44, 46. Recess 50, 52 is typically about 2" deep. After recesses 50, 52 are formed, surfaces 54, 56, 58, 60 of each recess 50, 52 are then cleaned.

A flexible membrane strip 62, advantageously composed of rubber material, is placed across gap and secured to base surface 54, 56 respectively so as to "bridge the gap" between slabs 44, 46. Strip 62 may be secured by first applying an acceptable adhesive 66 such as an epoxy to base surfaces 54, 56 and then placing respective ends **62*a*, 62*b* of strip 62 thereon. Once strip is secured, surfaces 54, 56, 58, 60 of each recess 50, 52 are preferably primed with an acceptable primer such as Rallithane 160 primer, a solvent-based primer imported exclusively by Pavetech International from a U.K. producer, Astor Stag. Strip 62 is not pulled tight across gap 48 when applied, but is permitted to sag or dip in the middle of gap 48 as shown in FIG. 2 at 64, to accommodate for expansion of gap 48 as shown in FIG. 3. When joint 42 expands upon decreasing temperatures, strip 62 is accordingly stretched as at 67**.

After securing membrane strip 62, generally L-shaped retainers 68 and 70 respectively are secured in recess 50, 52 to form a pair of opposing retainers 68, 70, as particularly shown in FIG. 4. Retainers 68, 70 may be secured by placing a layer of adhesive (not shown) on strip ends **62*a*, 62*b* of strip 62 and securing retainers 68, 70 respectively thereon. Retainers 68, 70 may be composed of any wire mesh material, preferably galvanized wire such as hardware cloth, sometimes referred to as chicken wire. A mesh size slightly less than the diameter of the aggregate is selected. A first side 68*a*, 70*a* of retainer 68, 70 is disposed upon membrane strip end 62*a*, 62*b* respectively, and secured thereto while a second side 68*b*, 70*b* of retainer 68, 70 extends generally perpendicularly from strip end 62*a*, 62*b*. Second side 68*b*, 70*b* is immediately adjacent to gap 48 and extends to about ⅛" to ½" below the top surface 45 and 47 respectively of slabs 44, 46 so that it will not be exposed to vehicles (not shown) travelling thereover once joint system 42** is complete.

After each retainer 68, 70 is secured in respective recess 50, 52, recesses 50, 52 are substantially filled with a mixture 72 of an initially liquid sealant **72*a* and an aggregate 72*b*. Mixture 72 is advantageously poured into respective recess 50, 52 in ¾" to 1" layers 74*a*, 74*b*, 74*c* until mixture 72 is about ⅛" to ¼" below top surfaces 45 and 47 respectively of slabs 44, 46**.

Sealant **72*a* is optimally Rallithane 862, imported exclusively by Pavetech International from Astor Stag. Rallithane is a cold-applied, two-part elastic polyurethane sealant specifically formulated for sealing expansion joints. Rallithane is highly resistant to various chemicals such as fuels, oils, salts, etc. Furthermore, Rallithane expands and contracts with varying environmental temperatures, which is a necessary quality for expansion joint system 42**.

Aggregate **72*b* of mixture 72 is preferably ¾" granite stone that is first cleaned, primed and dried, and then pre-coated with an acceptable sealant before being added to mixture 72. Priming aggregate 72*b* facilitates bonding between aggregate 72*b* and sealant 72*a*. Pre-coating aggregate 72*b* with sealant 72*a* helps to preserve and maintain the primer in its most effective state. The sealant used to pre-coat aggregate 72*b* may be Rallithane 862, which is used as the sealant 72*a* in mixture 72. The size of aggregate 72*b*** may vary and is not limited to ¾" stone. For example, ½" aggregate may be used, as well as various other sizes, and mixtures thereof.

When mixture **72*a* is poured into respective recess 50, 52, liquid sealant 72*a* flows from recess 50, 52 through retainers 68, 70 and into gap 48, with membrane strip 62 serving as a floor support for sealant 72*a*. Aggregate 72*b* is preferably kept out of gap 48 so that optimal expansion and contraction of sealant 72*a* can occur at gap 48 without any risk of voids or spaces forming between aggregate 72*b* and sealant 72*a*. If aggregate 72*b* were present in gap 48 during expansion and subsequent contraction of sealant 72*a*, aggregate 72*b* may become slightly loose from sealant 72*a* at gap 48. Once loose, aggregate 72*b* may shift positions so that sealant 72*a* would not tightly conform to the shape of aggregate 72*b* upon subsequent contraction, resulting in voids and spaces that might weaken joint system 42. While aggregate 72*b* provides strength and substance to joint system 42, it is preferably kept out of gap 48 so as not to create unnecessary risks of the formation of voids or spaces that might weaken joint system 42. Furthermore, it is undesirable for aggregate 72***b* to be in gap 48 because aggregate itself 72*b* is incapable of expanding or contracting. Much of the expansion and contraction occurs in gap 48, not in recesses 50, 52. It is thus desirable to exclusively have material in gap 48 that is capable of expanding and contracting accordingly.

After mixture 72 is within each recess 50, 52 and sealant 72*a* is within gap 48 to a level of about ⅛" to ¼" below top surface 45, 47 of slabs 44, 46, a final layer of sealant 76 is preferably applied thereon to a position of about 1/16" to ⅛" below top surface 45, 47 of adjacent slabs 44, 46. Before final layer of sealant 76 cures but when still sticky, a final layer of aggregate 78 is densely applied to sealant 76 to bring joint 42 to an even grade with abutting slabs 44, 46. Final layer of aggregate 78 is preferably a small-sized, fine granite stone such as ⅛"×1/16" stone. Final layer of aggregate 78 protects joint from the wear and tear of traffic (not shown) and from ultraviolet degradation, as well as provides a smooth surface for vehicles to travel over.

Joint 42 is durable as it is at an even grade with slabs 44, 46 and not recessed therefrom. Without the typical recession that is present in the prior art joint system 10 of FIG. 1, joint 42 of the present invention is not subject to additional deterioration caused by dirt and debris. Furthermore, joint system 42 of the present invention does not encounter the bonding difficulties as the joint system 10 of the prior art. Joint system 42 is comprised of a homogenous substance throughout the entire joint system 42. This homogeneity results in a more durable joint system 42 as there is no risk of bonds weakening or breaking between the gap-filling and recess-filling materials. Thus, with the same material consistent throughout gap 48 and recesses 50, 52, joint system 42 is stronger and more durable than joint system 10 of the prior art. Also, the entire joint system 42 of the present invention bonds to base surfaces 54, 56 and side wall surfaces 58, 60 of recesses 50, 52, creating a large bonding surface area, resulting in a tenacious joint system 42.

Based on the foregoing, it will be appreciated that the expansion joint system 42 and method of making the expansion joint of the present invention provides the ability to produce a long-lasting, cost-effective joint that is at an even grade with abutting surfaces. The method of making the joint system of the present invention is adapted preferably to roadways and bridges comprised of concrete slabs, not asphalt. Asphalt becomes worn down over time as traffic travels thereover, and ruts form in the asphalt. The joint system 42 of the present invention does not wear down as the asphalt does, and would thus,over time, protrude above the asphalt. Such a roadway or bridge with a rutting asphalt and protruding joint would not make a practical surface for vehicles to travel over.

While the present invention has been illustrated by the description of embodiments thereof, and while the embodiments have been described in considerable detail, it is not the intention of Applicants to restrict or in any way limit the scope of the appended claims to such detail. For example, an expansion joint may be formed without retainers such that aggregate, as well as sealant, is permitted to flow into gap. The invention in its broader aspect is, therefore, not limited to the specific details, representative joint system and method, and illustrative examples shown and described. Accordingly, departures may be made from such details without departing from the spirit of Applicants' general inventive concept.

What is claimed is:

1. A method of making an expansion joint for adjacent roadway slabs having a gap therebetween, comprising:

cutting or forming a recess into a top surface of each of said adjacent roadway slabs to form a pair of recesses parallel and adjacent to said gap, said recesses having a base surface generally parallel to the top surface of said slabs, and a side surface generally perpendicular to the top surface of said slabs;

cleaning said recesses;

placing a generally flexible membrane strip across said gap, said strip having a first end secured to one base surface and a second end secured to the other base surface;

substantially filling said recesses and said gap with a mixture of an initially liquid sealant and an aggregate; and applying a finishing layer of aggregate on top of said mixture, said layer of aggregate being in about a level position with the top surface of said roadway slabs so that a smooth joint is formed between said adjacent roadway slabs.

2. The method of claim 1 wherein said membrane strip is comprised of a rubber-based material.

3. The method of claim 1 wherein said aggregate of said mixture is about ¾" stone.

4. The method of claim 1 wherein said aggregate of said mixture is pre-coated with said sealant.

5. The method of claim 1 wherein said sealant is polyurethane based.

6. A roadway expansion joint system for adjacent roadway slabs having a gap therebetween, comprising:

a recess cut or formed into the surface of each of said adjacent roadway slabs forming a pair of recesses parallel and adjacent to said gap, said recesses having a base surface generally parallel to a top surface of said roadway slabs, and a side surface generally perpendicular to said top surface of said roadway slabs;

a generally flexible membrane strip extending across said gap, said strip having a first end secured to one base surface and a second end secured to the other base surface of said recesses;

a mixture of an initially liquid sealant and an aggregate disposed in said recesses and in said gap to substantially fill said recesses and said gap; and a finishing layer of aggregate disposed on top of said mixture, said layer of aggregate being in about a level position with the top surface of said roadway slabs so that a smooth joint is formed between said adjacent roadway slabs.

7. The expansion joint system of claim 6 wherein said membrane strip is comprised of a rubber material.

8. The expansion joint system of claim 6 wherein said aggregate of said mixture is about ¾" stone.

9. The expansion joint system of claim 6 wherein said aggregate of said mixture is pre-coated with said sealant.

10. The expansion joint system of claim 6 wherein said sealant is polyurethane based.

11. A method of making an expansion joint for adjacent roadway slabs having a gap therebetween, comprising:

cutting or forming a recess into a top surface of each of said adjacent roadway slabs to form a pair of recesses parallel and adjacent to said gap, said recesses having a base surface generally parallel to the top surface of said slabs, and a side surface generally perpendicular to the top surface of said slabs;

cleaning said recesses;

placing a generally flexible membrane strip across said gap, said strip having a first end secured to one base surface and a second end secured to the other base surface of said recesses;

securing a mesh retainer in each recess to form a pair of opposing retainers, a first portion of said retainer being disposed upon the end of said strip, and a second portion of said retainer extending generally perpendicularly from the end of said strip;

substantially filling said recesses with a mixture of an initially liquid sealant and an aggregate, said sealant flowing through said mesh retainers into said gap to a position above said membrane strip, said aggregate generally retained adjacent to said gap by said mesh retainers; and applying a finishing layer of aggregate on top of said mixture in said recesses and on top of said sealant in said gap, said layer of aggregate being in about a level position with the top surface of said roadway slabs so that a smooth gap joint is formed between said adjacent roadway slabs.

12. The method of claim 11 wherein said retainer is generally L-shaped.

13. The method of claim 11 wherein said second portion of said retainer extends generally perpendicularly to a position about ⅛" to ½" below said roadway slabs.

14. The method of claim 11 wherein said retainer is hardware cloth.

15. A roadway expansion joint system for adjacent roadway slabs having a gap therebetween, comprising:

a recess cut or formed into the surface of each of said adjacent roadway slabs forming a pair of recesses parallel and adjacent to said gap, said recesses having a base surface generally parallel to a top surface of said roadway slabs, and a side surface generally perpendicular to said top surface of said roadway slabs;

a generally flexible membrane strip extending across said gap, said strip having a first end secured to one base surface and a second end secured to the other base surface of said recesses;

a mesh retainer secured in each recess to form a pair of opposing retainers, a first portion of said retainer being disposed upon the end of said strip, and a second portion of said retainer extending generally perpendicularly from the end of said strip;

a mixture of an initially liquid sealant and an aggregate disposed in said recesses, said sealant further disposed in said gap above said membrane strip, said mixture substantially filling said recesses and said sealant substantially filling said gap; and a finishing layer of aggregate disposed on top of said mixture in said recesses and on top of said sealant in said gap, said layer of aggregate being in about a level position with the top surface of said roadway slabs so that a smooth joint is formed between said adjacent roadway slabs.

16. The roadway expansion joint system of claim 15 wherein said retainer is generally L-shaped.

17. The roadway expansion joint system of claim 15 wherein said second portion of said retainer extends generally perpendicularly to a position about ⅛" to ½" below said roadway slabs.

18. The roadway expansion joint system of claim 15 wherein said retainer is comprised of hardware cloth.

19. A method of making an expansion joint for adjacent roadway slabs having a gap therebetween, comprising:

cutting or forming a recess into a top surface of each of said adjacent roadway slabs to form a pair of recesses parallel and adjacent to said gap, said recesses having a base surface generally parallel to the top surface of said slabs, and a side surface generally perpendicular to the top surface of said slabs;

cleaning said recesses;

placing a generally flexible membrane strip across said gap, said strip having a first end secured to one base surface and a second end secured to the other base surface of said recesses;

substantially filling said recesses and said gap with a mixture of an initially liquid sealant and an aggregate;

pouring a coating of a sealant on top of said mixture; and applying a finishing layer of aggregate on top of said sealant, said layer being in about a level position with the top surface of said roadway slabs so that a smooth joint is formed between said adjacent roadway slabs.

20. A roadway expansion joint system for adjacent roadway slabs having a gap therebetween, comprising:

a recess cut or formed into the surface of each of said adjacent roadway slabs forming a pair of recesses parallel and adjacent to said gap, said recesses having a base surface generally parallel to a top surface of said roadway slabs, and a side surface generally perpendicular to said top surface of said roadway slabs;

a generally flexible membrane strip extending across said gap, said strip having a first end secured to one base surface and a second end secured to the other base surface of said recesses;

a mixture of an initially liquid sealant and an aggregate disposed in said recesses and in said gap to substantially fill said recesses and said gap;

a sealant coating disposed on top of said mixture; and a finishing layer of aggregate disposed on top of said sealant coating, said aggregate being in about a level position with the top surface of said roadway slabs so that a smooth joint is formed between said adjacent roadway slabs.

21. A method of making an expansion joint for adjacent roadway slabs having a gap therebetween, comprising:

cutting or forming a recess into a top surface of each of said adjacent roadway slabs to form a pair of recesses parallel and adjacent to said gap, said recesses having a base surface generally parallel to the top surface of said slabs, and a side surface generally perpendicular to the top surface of said slabs;

cleaning said recesses;

placing a generally flexible membrane strip across said gap, said strip having a first end secured to one base surface and a second end secured to the other base surface of said recesses;

securing a mesh retainer in each recess to form a pair of opposing retainers, a first portion of said retainer being disposed upon the end of said strip, and a second portion of said retainer extending generally perpendicularly from the end of said strip;

substantially filling said recesses with a mixture of an initially liquid sealant and an aggregate, said sealant flowing through said mesh retainers into said gap above said membrane strip, said aggregate generally retained adjacent to said gap by said mesh retainers;

pouring a coating of a sealant on top of said mixture in said recesses and on top of said sealant in said gap; and applying a finishing layer of aggregate on top of said sealant, said layer being in about a level position with the top surface of said roadway slabs so that a smooth joint is formed between said adjacent roadway slabs.

22. A roadway expansion joint system for adjacent roadway slabs having a gap therebetween, comprising:

a recess cut or formed into the surface of each of said adjacent roadway slabs forming a pair of recesses parallel and adjacent to said gap, said recesses having a base surface parallel to a top surface of said roadway slabs, and a side surface generally perpendicular to said top surface of said roadway slabs;

a generally flexible membrane strip extending across said gap, said strip having a first end secured to one base surface and a second end secured to the other base surface of said recesses;

a mesh retainer secured in each recess to form a pair of opposing retainers, a first portion of said retainer being disposed upon the end of said strip, and a second portion of said retainer extending generally perpendicularly from the end of said strip;

a mixture of an initially liquid sealant and an aggregate disposed in said recesses, said sealant further disposed in said gap above said membrane strip, said mixture substantially filling said recesses and said sealant substantially filling said gap;

a sealant coating disposed on top of said mixture in said recesses and on top of said sealant in said gap; and a finishing layer of aggregate disposed on top of said sealant coating, said aggregate being in about a level position with the top surface of said roadway slabs so that a smooth joint is formed between said adjacent roadway slabs.

* * * * *